US006671915B2

(12) United States Patent
Bringewatt et al.

(10) Patent No.: US 6,671,915 B2
(45) Date of Patent: Jan. 6, 2004

(54) METHOD FOR THE WET TREATMENT OF LAUNDRY

(75) Inventors: Wilhelm Bringewatt, Bad Oeynhause (DE); Falk F. Mehrmann, Walsrode (DE)

(73) Assignee: Pharmagg Systemtechnik, GmbH, Bad Oeynhausen (DE)

( * ) Notice: Subject to any disclaimer, the term of this patent is extended or adjusted under 35 U.S.C. 154(b) by 0 days.

(21) Appl. No.: 09/880,189

(22) Filed: Jun. 13, 2001

(65) Prior Publication Data

US 2001/0054203 A1 Dec. 27, 2001

(30) Foreign Application Priority Data

Jun. 14, 2000 (DE) ..... 100 31 037

(51) Int. Cl.[7] ..... D06F 37/36
(52) U.S. Cl. ..... 8/159; 68/12.12; 68/24
(58) Field of Search ..... 68/12.01, 12.02, 68/12.16, 12.12, 24, 58, 140, 210; 210/402, 143; 8/158, 159

(56) References Cited

U.S. PATENT DOCUMENTS

| | | | | |
|---|---|---|---|---|
| 2,556,490 | A | * | 6/1951 | Chamberlin |
| 3,188,838 | A | * | 6/1965 | Hubbard |
| 3,293,889 | A | * | 12/1966 | Cobb et al. |
| 3,840,764 | A | * | 10/1974 | Burger |
| 4,446,706 | A | * | 5/1984 | Hartwig |
| 4,489,455 | A | * | 12/1984 | Spendel |
| 4,513,464 | A | * | 4/1985 | Rettich et al. |
| 4,916,768 | A | * | 4/1990 | Broadbent |
| 5,335,524 | A | * | 8/1994 | Sakane |
| 5,560,061 | A | * | 10/1996 | Wentzlaff et al. |
| 5,647,232 | A | * | 7/1997 | Boldt et al. |
| 5,726,546 | A | * | 3/1998 | Harwood |
| 6,247,339 | B1 | * | 6/2001 | Kenjo et al. |
| 6,257,027 | B1 | * | 7/2001 | Imai |

FOREIGN PATENT DOCUMENTS

| | | | |
|---|---|---|---|
| CH | 659841 | * | 2/1987 |
| DE | 37 12 118 | A1 | 11/1987 |
| DE | 41 15 776 | A1 | 11/1992 |
| DE | 41 16 673 | A1 | 11/1992 |
| DE | 43 36 350 | A1 | 4/1995 |
| DE | 196 11 089 | A1 | 9/1997 |
| DE | 42 26 058 | C2 | 3/1999 |
| GB | 882 281 | A | 11/1961 |
| JP | 61-25592 | * | 2/1986 |

(List continued on next page.)

OTHER PUBLICATIONS

Copy of German Patent Office Search Results (Deutsches Patent—und Markenamt Ergebnis einer Druckschriftenermittlung.
Senking Posten–Durchlauf–Wascher Transit–P16.
PS Posten–Waschanlage.

*Primary Examiner*—Frankie L. Stinson
(74) *Attorney, Agent, or Firm*—Technoprop Colton LLC

(57) ABSTRACT

Tunnel washing machines (10) are equipped with a rotary driven drum (12), through which the laundry to be subjected to wet treatment is conveyed longitudinally. For achieving the greatest possible performance in treatment, the goal is to drive the drum (12) at the highest possible circumferential speed. However, the result of this is that the laundry is not (completely) thrown off the paddle blades (21) in the drum (12). This, has a negative effect on the results of treatment.

The method according to the invention proposes that the drum (12) be driven with different circumferential speeds. When the laundry is thrown off the paddle blades (21) the drum (12) and its circumferential speed is thereby considerably reduced, thus causing the laundry to drop from the paddle blades (21) in a complete and reliable manner.

18 Claims, 3 Drawing Sheets

FOREIGN PATENT DOCUMENTS

| | | | |
|---|---|---|---|
| JP | 61-73689 | * | 4/1986 |
| JP | 61-87589 | * | 5/1986 |
| JP | 63-183090 | * | 7/1988 |
| JP | 3-242197 | * | 10/1991 |
| JP | 3-284286 | * | 12/1991 |
| JP | 3-2855596 | * | 12/1991 |
| JP | 4-30895 | * | 2/1992 |
| JP | 4-90791 | * | 3/1992 |
| JP | 4-266796 | * | 9/1992 |
| JP | 4-276293 | * | 10/1992 |
| JP | 4-295399 | * | 10/1992 |
| JP | 4-327887 | * | 11/1992 |
| JP | 5-49780 | * | 3/1993 |
| SU | 918360 | * | 4/1982 |
| WO | WO 98 29594 A | | 7/1998 |
| WO | WO 98/29594 | * | 7/1998 |

* cited by examiner

METHOD FOR THE WET TREATMENT OF LAUNDRY

BACKGROUND OF THE INVENTION

1. Technical Field

The invention relates to a method for the wet treatment of laundry items with the laundry being at least washed in a rotary driven drum.

2. Prior Art

Employed for the wet treatment of laundry items, particularly in commercial laundries, are so-called continuous tunnel washing machines which have a rotary driven drum which revolves about a preferably horizontal center axis. In the elongate drum, laundry items are, in a continuous pass, washed, rinsed and if necessary subjected to other treatment, in particular aftertreatment. The drum is driven in a preferably rotating, circulatory manner, thus executing complete circular movements during the wet treatment of the laundry. Arranged in the drum are built-in elements, in particular paddle blades. Permanently fixed in the drum, the paddle blades turn in the circumferential direction of the drum, thus serving to carry along the laundry within the drum and, according to need, to transport the laundry through the drum in its longitudinal direction.

During part of each revolution of the drum, the laundry lies in front of the paddle blades as well as upon the inner side of the drum. When, during the rotational actuation of the drum, the off-center paddle blades within the drum reach or pass through an upper cusp point (apex), the laundry drops into the interior of the drum due to gravity. This results in the laundry being thrown off the paddle blades and the inner side of the drum shell.

In order to increase the handling performance of tunnel washing machines, one aims at propelling the drum at the highest possible frequency of rotation, thus causing the drum to rotate at a correspondingly high speed. With increasing speed or rotational frequency, the laundry, particularly due to centrifugal forces, tends to adhere to the paddle blades and to the surfaces of the drum shell. This means that the laundry does not completely drop off when the paddle blades pass through the apex point in the drum. Having the laundry thrown off and drop down is essential for an effective washing and/or rinse cycle. Therefore, even incomplete throwing off and dropping down of the laundry results in a reduced intensity of the treatment; in particular, there is a drop in performance in washing and/or rinsing. The greater rotational frequency or driving speed of the drum thus becomes practically ineffective.

BRIEF SUMMARY OF THE INVENTION

Proceeding from the above, the invention is based on the problem of creating a method for a more effective and efficient wet treatment of laundry.

A method for solving this problem is characterized in that the drum is driven with different rotational frequencies. By having the drum driven at different rotational frequencies (in other words: different rotary frequencies or different number of revolutions), its rotational speed can be varied to meet these requirements. The disadvantages posed by driving the drum at a higher rotational frequency can be eliminated by a temporary or intermittent reduction of the rotational frequency. The faster drum drive speed at all other times can thus fully exploit the advantages of the drum action.

The drum is driven preferably in rotation, with the drum being driven at different rotational frequencies during at least some, preferably during all, of its revolutions. The drum is thereby driven with a different velocity profile during at least some of its revolutions, with slower drive speeds being selected when disadvantages arising from too rapid drive speeds may be encountered. The drum is driven more rapidly in those circumferential areas of the drum in which higher drive speeds do not have a disadvantageous effect on the performance of treatment, in particular concerning washing and/or rinsing efficiency, which on the whole makes it possible to achieve a greater efficiency in treatment using tunnel washers.

Pursuant to a preferred method, the drum is driven at a plurality of, preferably two, different rotational frequencies during a respective revolution, with each frequency being held essentially constant during its segment of the drum revolution. Accordingly, the drum runs at the same speed in the respective area, which results in an even wet treatment of the laundry.

It is also provided that the drum is to be braked or accelerated between the drive phases of the drum by means of applying a lower or higher rotational frequency, respectively. This gives a stepped velocity profile, with the phases of drum acceleration or braking serving to attain a higher or lower rotational frequency and/or circumferential speed (in other words: rotational speed) of the drum. In particular, braking the drum from the higher circumferential frequency to the lower circumferential frequency applies a impetus force on the laundry, which facilitates the loosening of the laundry from the drum and the paddle blades, and in particular ensures a more effective and above all more complete throwing off of the laundry.

According to a further proposal of the invention, the drum is driven with the higher rotational frequency over a greater segment of its circumference that with the lower rotational frequency. This keeps the reduction of the drum drive speed to a minimum but at the same time retains to the maximum possible degree the performance advantage offered by the higher circumferential speed of the drum.

It is furthermore provided that when built-in elements of the drum, in particular paddle blades for carrying along the laundry, reach an upper region of reversed direction (apex) of the drum, the drum is driven at a slower circumferential speed or rotational frequency. Accordingly, the drum is driven more slowly as the laundry is thrown off and this reduces the centrifugal forces which might otherwise hold the laundry to the paddle blades and inner side of the drum shell. This results in an effective and in particular complete throwing off of the laundry in that it can loosen more easily from the inner walls of the drum and the paddle blades due to the lower circumferential speed of the drum.

Pursuant to a preferred embodiment of the method, when the paddle blades reach the upper reverse area of the drum—or even shortly before that—the drive of the drum is braked enough for the drum to shift from the higher rotational frequency to the lower rotational frequency. This braking action gives the laundry a dynamic impetus which favors its loosening from the paddle blades and the inner side of the drum wall, thus ensuring a reliable throwing off of the entire laundry at the apex of the drum. This not only represents an improvement in the efficiency of throwing off laundry at the apex region of blade motion by reducing the circumferential speed of the drum. This also favors and enhances the reliable throwing off of laundry by the braking of the drum required for reducing its rotational speed.

BRIEF DESCRIPTION OF THE DRAWINGS

A preferred embodiment of the invention will be described in more detail below on the basis of the drawings, which show.

DETAILED DESCRIPTION OF THE PREFERRED EMBODIMENTS

Figure 2:
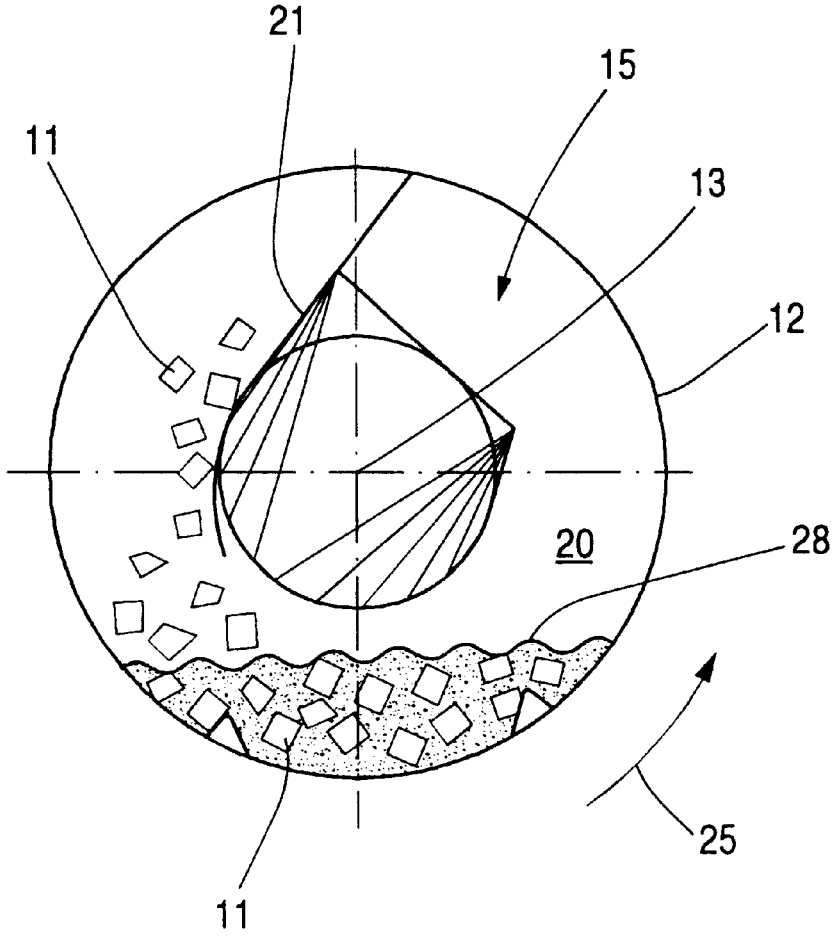
Figure 3:
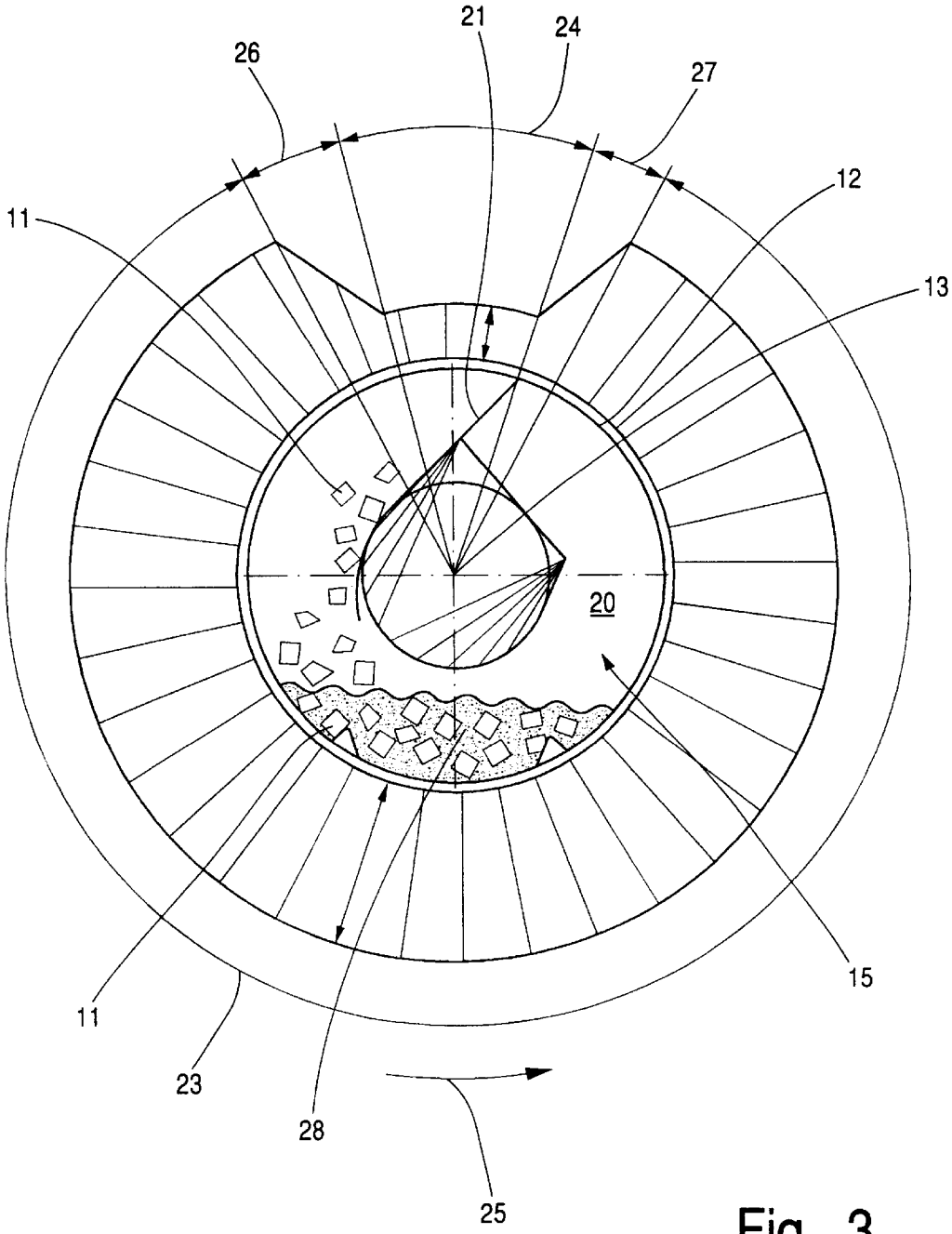

The shown tunnel washing machine 10 is employed preferably for the wet treatment of laundry items in commercial laundries. In the tunnel washing machine 10 the laundry items 11, schematically represented in FIGS. 2 and 3, are washed, rinsed and, if necessary, subjected to aftertreatment, such as a finishing. The tunnel washing machine 10 has a elongate drum 12 with a cylindrical drum shell. The drum can be driven rotationally about a horizontal longitudinal center axis 13. In the drum washing machine 10 shown here, the drum is driven completely or to a great extent in rotation. The drum 12 thus executes complete circular revolutions in succession.

The drum 12 of the tunnel washing machine 10 shown here is divided into different zones, namely a washing zone, which may comprise a pre-wash zone and a clear-wash zone, a rinsing zone and, if necessary, a finishing zone. The washing zone, the rinsing zone and any finishing zone are arranged in the successive direction of treatment 14 in the drum 12 of the tunnel washing machine 10. The washing zone, the rinsing zone and also any finishing zone are formed from a plurality of successive chambers 15 in the longitudinal direction of the drum 12, with any number of chambers being possible, i.e. not limited to the number of those in the exemplary embodiment shown in FIG. 1. In particular, the chambers 15 can have various built-in elements.

Arranged before a feed end 16 of the drum 12 of the tunnel washing machine 10 (at the left in FIG. 1) is a hopper feeder 17. The laundry items 11 to be washed are introduced at the feed end 16 through the hopper feeder 17 into the drum 12 of the tunnel washing machine 10. In the shown exemplary embodiment, a discharge slide 19 is arranged at the rear (right-hand side in FIG. 1) discharge end 18 of the drum 12 of the tunnel washing machine 10. Washed laundry items 11, which exit the drum at the discharge end 18, are transported out of the tunnel washing machine 10 on the discharge slide 19, if necessary to a following hydroextraction machine (not shown), such as a drainage press.

The individual chambers 15 of the drum 12 are separated from one another by vertical partitions 20 running perpendicular to the longitudinal center axis 13 of the drum 12. The individual chambers 15 are connected to the single-piece drum 12, which runs continuously over the entire longitudinal center axis 13, in the regions of the partitions 20. The partitions 20 between the chambers 15 exhibit openings. Built-in elements, specifically paddle blades 21, are provided between each two adjacent partitions 20 in preferably every chamber 15. In particular a paddle blade 21 is provided in each chamber 15, and the paddle blades 21 of all chambers 15 can be of the same or different configuration.

Figure 1:
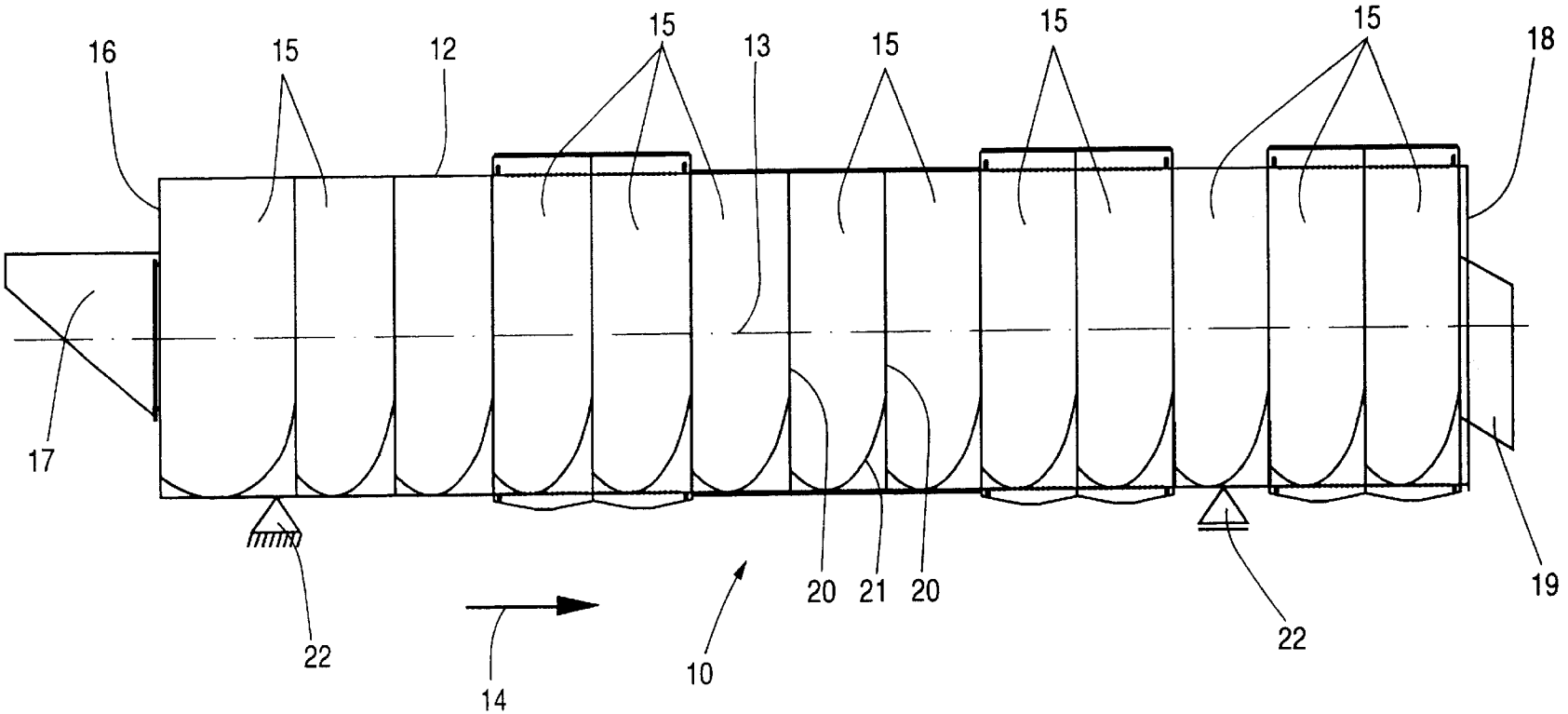
FIG. 1 a schematic side view of a tunnel washing machine for carrying out the method according to the invention, FIG. 2 a cross-sectional view of a drum of the tunnel washing machine, and FIG. 3 a cross-sectional view analogous to FIG. 2 with a schematic velocity profile of a revolution of the drum of the tunnel washing machine.

The drum 12 is movable by means of the bearing 22, shown symbolically in FIG. 1, namely supported rotationally on a frame (not shown) of the tunnel washing machine 10. The bearing 22 is configured as running wheels on which the shell of the drum rests such that during the rotational drive of the drum 12, the shell moves about the longitudinal center axis 13 by rolling contact on the running wheels.

According to the invention, the drum 12 is driven in a special manner. This drive action occurs at different rotational frequencies. In the shown exemplary embodiment, the drum is driven at two different rotational frequencies. Each of the two rotational frequencies is constant over a segment of the revolution of the drum 12. The velocity profile for one revolution of the drum 12 is represented schematically in FIG. 3 around the circumference of the drum 12. Accordingly, the drum is driven over a greater segment 23 of its circumference or of a revolution at a higher rotational frequency of up to fourteen revolutions per minute. This rotational frequency is constant over the greater segment 23 of the revolution of the drum 12. The drum 12 is driven at a smaller, constant rotational frequency over a smaller segment 24 of its circumference. The smaller rotational frequency has a maximum rate of 5 revolutions per minute, thus being a third less than the larger rotational frequency. Seen in the direction of revolution 25, the segment 23 with the higher rotational frequency is followed by a braking phase 25, which in turn extends over a small segment of the circumference of the drum 12. During the braking phase 26, the drum 12 is steadily braked from the higher rotational frequency (segment 23) to the lower rotational frequency (segment 24). Seen in the direction of revolution 25, the lower rotational frequency is followed by an acceleration phase 27. This too extends over a small segment of the circumference of the drum 12 and serves to accelerate the drum from the lower rotational frequency (segment 24) to the higher rotational frequency (part 23).

The segment 24 of the circumference of the drum 12 where it is driven with lower rotational frequency is located at the upper reversal area of the paddle blades 21 in the respective chamber 15 of the drum 12, i.e. where the laundry items 11 reach the apex of the drum 12 and are here thrown off the paddle blades 21 by dropping down in the chamber 15 (FIG. 3). The segment 24 of the circumference of the drum 12 in which it is driven with the lower rotation frequency, begins approximately at that point where the middle of the paddle blade 21 reaches the highest point in the drum 12, i.e. where it intersects a vertical longitudinal center axis of the drum 12. The segment 24, where the drum 12 is driven with the lower rotational frequency, ends at the point where one end of the paddle blade 21 meets the inner side of the shell of the drum 12. This ensures that the drum 12 is driven at the constant lower rotational frequency when the laundry items 11 are thrown off the paddle blade 21 of the respective chamber 15. This smaller segment 24 of the drum 12, which revolves at a constant lower speed, extends in the shown exemplary embodiment along approximately 32° of the circumference of the drum 12. In contrast, segment 23, where the drum 12 is driven at the higher circumferential speed, is considerably larger, occupying in the shown exemplary embodiments approximately 305° of the circumference of the drum 12. The braking phase 26 in the shown exemplary embodiment extends about 13° of the circumference of the drum 12. By comparison, the acceleration phase is somewhat smaller, extending namely in the exemplary embodiment only over approximately 10° of the circumference of the drum 12. Depending on the configuration of the paddle blades 21, the segments 23 and 24 for driving the drum 12 at a constant higher or lower circumferential speed can be either larger or smaller than those of the exemplary embodiment shown in FIG. 3. Likewise, the braking phase 26 and the acceleration phase 27 can be greater or smaller than those of the shown exemplary embodiment. The braking phase 26 and the acceleration phase 27 can also be of the same magnitude if necessary, or the acceleration phase 27 can be greater than the braking phase 26. The exact lengths of these phases depends no only on the configuration of the paddle blades 21 and other built-in elements, but also on the ratio of the different speeds. They can therefore be varied to meet actual requirements so that the invention is not limited to the circumferential speed profile of the drum 12 as shown in FIG. 3.

By driving the drum 12 at different rotational frequencies, in particular with the speed profile shown in FIG. 3, during a revolution of the drum 12, it is possible to drive it at a relatively high circumferential speed in such a phase where the laundry items 11 can and should lie on the inner side of the wall of the drum 12 and temporarily also on the paddle blades 21 of the respective chamber 15 for being lifted out of the liquid bath 28. On the other hand, for throwing the laundry items 11 off the paddle blades 21, the drive of the drum 12 is braked during the braking phase 26 at constant deceleration to the lower circumferential speed. This lower circumferential speed is attained at the latest when the laundry items 11 start to be thrown off the paddle blades 21, preferably somewhat later, with the deceleration occurring during the braking phase 26 favoring a loosening of the laundry items 11 from the paddle blades 21 and inner shell of the wall of the drum 12, in particular by generating an additional throw-off impetus. As soon as the rear end of the paddle blade 21 bordering the shell of the drum 12 reaches the highest point in the chamber 15, namely the apex of the drum 12, and the process of throwing the laundry items 11 off the paddle blade 21 is completed, the drum 12 is put under constant acceleration along the acceleration phase 27 in order to attain the higher circumferential speed for lifting once again the laundry items 11 out of the liquid bath 28. This operation can extend over singular, but also multiple complete revolutions of the drum 12. It is also conceivable to drive the drum 12 constantly with alternating rotational frequencies of various magnitudes, in particular with a circumferential speed profiles as shown for example in FIG. 3.

List of Designations

10 tunnel washing machine
11 laundry item
12 drum
13 longitudinal center axis
14 direction of treatment
15 chamber
16 feed end
17 hopper feeder
18 discharge end
19 discharge slide
20 partition
21 paddle blade
22 bearing
23 segment (greater)
24 segment (smaller)
25 direction of revolution
26 braking phase
27 acceleration phase
28 liquid bath

What is claimed is:

1. A method for wet treatment of laundry, with the laundry being at least washed in a rotary driven drum (12), characterized in that a. the drum (12) is driven with different rotational frequencies, b. braking and acceleration of the drum (12) occurs between the phases of driving the drum (12) with a constant lower rotational frequency and a constant higher rotational frequency, and c. the drum (12) is driven with the higher rotational frequency over a greater segment (23) of a revolution of the drum.

2. Method according to claim 1, characterized in that the drum (12) is rotary driven and that the drum (12) is driven with different rotational frequencies during at least some revolutions of the drum.

3. Method according to claim 1, characterized in that the drum (12), during at least one revolution, is driven with a plurality of rotational frequencies, with at least one circumferential speed being essentially constant over a segment of a revolution of the drum.

4. Method according to claim 1, characterized in that the drum (12) is driven with two different rotational frequencies during at least one revolution of the drum.

5. Method according to claim 1, characterized in that the drum is driven with a drive, and the drive of the drum (12) is braked from the higher rotational frequency to the lower rotational frequency and that after passing through a smaller segment (24) of a revolution of the drum (12) with the lower rotational frequency the drive of the drum (12) is again accelerated to the higher rotational frequency.

6. Method according to claim 1, characterized in that the laundry is carried along during the respective revolution of the drum (12) by built-in drum elements while lying on the inner side of the shell of the drum (12) and that the laundry drops down inside the drum (12) in an upper reversal region of built-in drum elements and is accelerated during an acceleration phase to the higher rational frequency of the drum (12).

7. Method according to claim 6, characterized in that the drum (12) is braked to the lower rotational frequency before it reaches the upper reversal area of the built-in drum elements and, after throwing-off of the laundry from the built-in drum elements, the laundry is accelerated during an acceleration phase to the higher rotational frequency of the drum (12).

8. Method according to claim 1, characterized in that the greater segment (23) of the circumference of the drum (12) driven with a higher rotation frequency is greater than the smaller segment (24) of the circumference of the drum (12) which is driven with a lower rotational frequency.

9. Method according to claim 1, characterized in that the drum (12) is braked from the greater rotational frequency to the lower rotational frequency along a braking phase (26).

10. Method according to claim 9, characterized in that the braking of the drum (12) to the lower rotational frequency occurs continuously.

11. Method according to claim 1, characterized in that the drum (12) is brought from the lower rotational frequency to the greater rotational frequency during an acceleration phase (27).

12. Method according to claim 11, characterized in that the acceleration of the drum (12) to the rotational frequency occurs continuously.

13. Method according to claim 1, characterized in that the drum is driven at only two different constant frequencies.

14. A method for wet treatment of laundry, with the laundry being at least washed in a rotary driven drum (12), characterized in that a. the drum (12) is driven with different rotational frequencies, and b. the drum (12) is driven with a higher rotational frequency over a greater segment (23) of its revolution.

15. The method according to claim 14, wherein the braking and acceleration of the drum (12) occurs between the phases of driving the drum (12) with a constant lower rotational frequency and a constant higher rotational frequency.

16. Method according to claim 15, characterized in that the laundry is carried along during the respective revolution of the drum (12) by built-in drum elements while lying on the inner side of the shell of the drum (12) and that the laundry drops down inside the drum (12) in an upper reversal region of built-in drum elements and is accelerated during an acceleration phase to the higher rational frequency of the drum (12).

17. Method according to claim 16, characterized in that the drum (12) is braked to the lower rotational frequency before it reaches the upper reversal area of the built-in drum elements and, after throwing-off of the laundry from the built-in drum elements, the laundry is accelerated during an acceleration phase to the higher rotational frequency of the drum (12).

18. A method for wet treatment of laundry, with the laundry being at least washed in a rotary driven drum (12) characterized in that:

a. the drum (12) is driven with different two different constant rotational frequencies, b. the drum (12) is brought from the higher rotational frequency to the lower rotational frequency in a braking phase, the drum (12) is brought from the lower rotational frequency to the higher rotational frequency in an acceleration phase, and the braking and acceleration of the drum (12) occurs between the phases of driving the drum (12) with a constant lower frequency and a constant higher rotational frequency, c. the drum (12) is driven with the higher frequency over a greater segment (23) of its revolution, d. the acceleration of the drum (12) to the higher rotational frequency occurs continuously, and e. a greater segment (23) of the circumference of the drum (12) driven with a higher rotation frequency is greater than a smaller segment (24) of the circumference of the drum (12) which is driven with a lower rotational frequency.

* * * * *